United States Patent [19]

Brinz

[11] Patent Number: 5,010,932

[45] Date of Patent: Apr. 30, 1991

[54] ADJUSTABLE SAILBOARD BOOM HANDLE APPARATUS

[76] Inventor: Joseph A. Brinz, 1040 Focis St., Apt. 14, Metairie, La. 70005

[21] Appl. No.: 377,701

[22] Filed: Jul. 10, 1989

[51] Int. Cl.[5] ..... B63B 35/79

[52] U.S. Cl. ..... 114/39.2; 114/97

[58] Field of Search ..... 114/39.2, 97, 98, 99; 16/111 R, 115

[56] References Cited

U.S. PATENT DOCUMENTS

| | | | |
|---|---|---|---|
| 1,059,054 | 4/1913 | Lindelien | 16/115 X |
| 4,068,346 | 1/1978 | Binder | 16/115 X |
| 4,418,631 | 12/1983 | Frohbach | 114/39.2 |
| 4,448,142 | 5/1984 | Pollard | 114/39.2 |
| 4,466,373 | 8/1984 | Prade et al. | 114/39.2 |
| 4,516,873 | 5/1985 | Humble et al. | 403/191 |
| 4,523,537 | 6/1985 | Kowol | 114/39.2 X |
| 4,730,568 | 3/1988 | Campbell | 114/39.2 |
| 4,745,870 | 5/1988 | Roth | 114/39.2 |
| 4,759,306 | 7/1988 | McKenzie | 114/39.2 |
| 4,785,755 | 11/1988 | Markison | 114/39.2 |

*Primary Examiner*—Sherman Basinger

*Attorney, Agent, or Firm*—Pravel, Gambrell, Hewitt, Kimball & Krieger

[57] ABSTRACT

An adjustable sailboard boom handle apparatus for use with a board sailor having an elongated flat buoyant board with a mast that carries a sail. The mast is movably attached to the board's center portion. A transverse hand held boom attaches to the mast and generally encircles the sail providing a surface for gripping by the sailor. A pair of fore/aft sleeve-like attachments are affixable to and spaced apart in fore/aft positions along the boom. A handle assembly is attached to the pair of attachments and extends therebetween, providing a portion which is spaced from the boom generally between the attachments. The handle assembly provides a gripping surface spaced from the boom during use, the handle assembly providing a surface for gripping with a hand of the user that is annularly oriented to the longitudinal center line of the boom between attachments.

10 Claims, 3 Drawing Sheets

ADJUSTABLE SAILBOARD BOOM HANDLE APPARATUS

BACKGROUND OF THE INVENTION

1. Field of the Invention

The present invention relates to windsurfers, sailboards, and the like and more particularly relates to an improved sailboard handle apparatus which relieves user fatigue caused by twisting, generally at the wrist area during wind sailing over a long period of time. Even more particularly, the present invention relates to an improved handle assembly for use with the boom portion of windsurfers wherein improved geometry and configuration afford a gripping surface which is angularly oriented with respect to the boom at the point of attachment of the handle so that user fatigue in the wrist and hand area is minimized.

2. General Background

A wind surfer or sailboard is a sailing vessel having an elongated buoyant board having a rounded nose portion which is upturned slightly and with a tail portion which carries a rudder or skeg on the underside. The upper side of the board provides usually a pair of spaced apart foot straps. At the central portion of the board on its upper surface there is provided a pivotal (e.g., ball and socket type) attachment for a mast. The mast carries a sail, and a generally oval shaped boom affixes to the mast and generally encircles or envelopes the sail. During use, a user stands on the rearward portion of the board placing his or her feet in the foot straps and holds onto the boom. The sailor then positions the mast and sail in various positions to maximize speed and to turn the vessel depending upon wind and wave conditions.

Wind sailing requires physical strength and stamina in that the user must lean rearwardly while holding the boom in order to transfer load between the sail/mast assembly and the board during propulsion of the vessel. This activity can produce muscle fatigue over long periods of time and that the wrists and arms must constantly transfer the body weight to the boom in order to make the vessel sail properly.

One of the problems with sailboards is the fact that the generally oval or elliptical boom provides a gripping surface which is not compatible with the biomechanics of the human forearm, wrist, and hand. While the rearmost positioned hand grips the boom in a favorable position or configuration, the majority of the stress is transferred to the forwardly positioned hand which extends away from the boom at an acute angle thus causing the user's wrist to be twisted so that the hand and forearm are angled with respect to one another. Over a long period of time this awkward positioning produces a great deal of fatigue which prevents the user from properly manipulating and supporting the boom and thus adversely affects the operation of the vessel.

Various patents have addressed the problem of the gripping of the sailboard boom with hand over a long period of time. One recently issued patent entitled "Sailboard Hand Grip" is U.S. Pat. No. 4,785,755 issued to Robert Markinson. In the Markinson patent, it is stated that to ease the fatigue and strain, the hands should meet the wrists in a horizontal plane in the same neutral position that exists when the hand and the arm are in a passive dependent position beside the trunk with flexors and extensors in balance. The Markinson patent also discusses the stress imposed on the hands and arms of a wind sailor. Tendonitis in the wrist and hand and wrist strains result because of the unaccustomed forward hand position on the boom.

In U.S. Pat. No. 4,418,631 entitled "Apparatus For Controlling a Wind Propelled Sailing Device" there is provided a substantially rigid control member preferably including a pair of spaced apart rigid rods pivotally connected at one end to the boom in an angular direction and rigidly connected to the other end at a second end with a handle member. The connecting mechanism connects the rigid rods to the boom in an angular direction while preventing movement of the control member along the boom's axis. The apparatus allows the sailor to increase his counter-balancing force by allowing the sailor to lean further into the wind while minimizing reduction in effective sail area.

The Pollard U.S. Pat. No. 4,448,142 entitled "Boom Assembly For Sailboard" provides a boom assembly that is pivotally attached to the mast of the sailboard for pivotal movement between a use position and a storage position.

Another example of a wind operated surf boards construction is seen in the Prade U.S. Pat. No. 4,466,373 entitled "Footloops On Surfboards". An example of a sailboard boom-to-mast connector is seen in U.S. Patent 4,516,873 issued to Humble et al.

The Campbell U.S. Pat. No. 4,703,568 shows an example of a sailboard construction wherein the craft includes a smooth rounded elongated sailboard type hull of little depth. The hull tapers down in width and in depth from its middle toward its ends and has smooth upper and lower surfaces. A cockpit extends downwardly into the hull from its upper surface to provide a craft useable in canoe mode.

A windsurfing harness is the subject of U.S. Pat. No. 4,745,870 issued to Jon Roth. The harness uses a cross shoulder brace at least two rear arms support braces to which are attached means such as boom hook straps or gloves in order to securely hold a windsurfer to the sailboard boom while being easily disengageable from the bottom if necessary.

U.S Pat. No. 4,759,306 entitled "Supporting Assemblies" provides an assembly for securing a persons hand to the sail wishbone of a sailboard which includes a connected assembly having a pair of mounting devices which may be fitted adjustably about the thumb and wrists respectively, a connector portion adapted to pass behind the wishbone and a retention device or bar for retention by finger pressure.

U.S. Pat. No. 4,785,755 entitled "Sailboard Handgrip" issued to Markison provides a handgrip extension to be attached to the boom of a sailboard. The extension permits the user to comfortably grip the forward end of the boom to minimize injury and discomfort while allowing greater control in speed in sailboarding.

None of the above references discloses nor suggest the combination sought to be patented herein wherein an improved handle assembly for sailboards is provided which affords a comfortable aergonomic grip for a sailboard user while at the same time forming a structural rigid support with the boom which transmits load between the boom and the user in both fore and aft directions to evenly distribute load transfer while minimizing fatigue to the user.

The present invention provides an improved adjustable boardsailing boom handle attachment. This adjustable boom handle would reduce stress and strain to the sailor's wrists and arms. It would also enable each sailor to maintain greater control of his sail at high speeds. Furthermore, the adjustability feature of this handle would enable each sailor to attach the handle to the boom in several options desired, pre-set positions.

It is important to note that in boardsailing one of the most important factors is control of the sail. This is achieved by controlling the amount of wind which the sailor allows to enter to the luff of the sail. It is therefore, the forward most hand on the boom which controls this factor. Hence, the closer the forward most hand is to the mast, the less wind is allowed into the luff. Therefore, greater control is achieved, but speed is restrained. On the other hand, if the forward most hand is moved away from the mast, more wind is allowed into the sail. Therefore higher speeds are achieved, but control is hampered.

A comfortable grip is also an important factor. Many times a sailor will have a very comfortable grip on the boom, but his performance is hampered. On the other hand, a sailor might suffer from strained wrists and arms, even though his performance is good. In other words, there is usually a trade off. Good performance, strained wrists and arms. Poor performance, comfortable grip.

SUMMARY OF THE PRESENT INVENTION

The present invention provides an improved adjustable sailboard boom handle apparatus for use with a board sailor having a flat elongated buoyant board with a mast that carries a sail, the mast movably attached to the board at its central portion and a transverse hand held boom attached to the mast and generally encircling the sail. A pair of fore/aft spaced apart attachments are affixable to the boom in fore and aft positions along the boom. A handle assembly is attached to the pair of attachments and provides a gripping surface spaced from the boom during use, the handle assembly providing a surface for gripping with a hand of the user that is angularly oriented to the longitudinal centerline of the boom between the attachments.

In the preferred embodiment, the attachments are sleeve-like members that are removably attached about the boom.

In the preferred embodiment, the handle assembly includes a pair of separate handle members connected end to end during use forming a generally triangular configuration with the boom.

In the preferred embodiment, at least one of the handles has two or more disconnectable center sections that can be interchanged to define various preselected handle lengths so that the handle assembly's geometry can be varied.

In the preferred embodiment, the boom has a generally circular cross-section in the sleeve-like members are sleeves, each rotatable about the boom so that the handle can be circumferentially rotated about the generally circular cross-section of the boom as an adjustment to the user's hand position.

In the preferred embodiment, each sleeve includes quick release mechanisms for quickly connecting-/releasing the sleeve to/from the boom.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
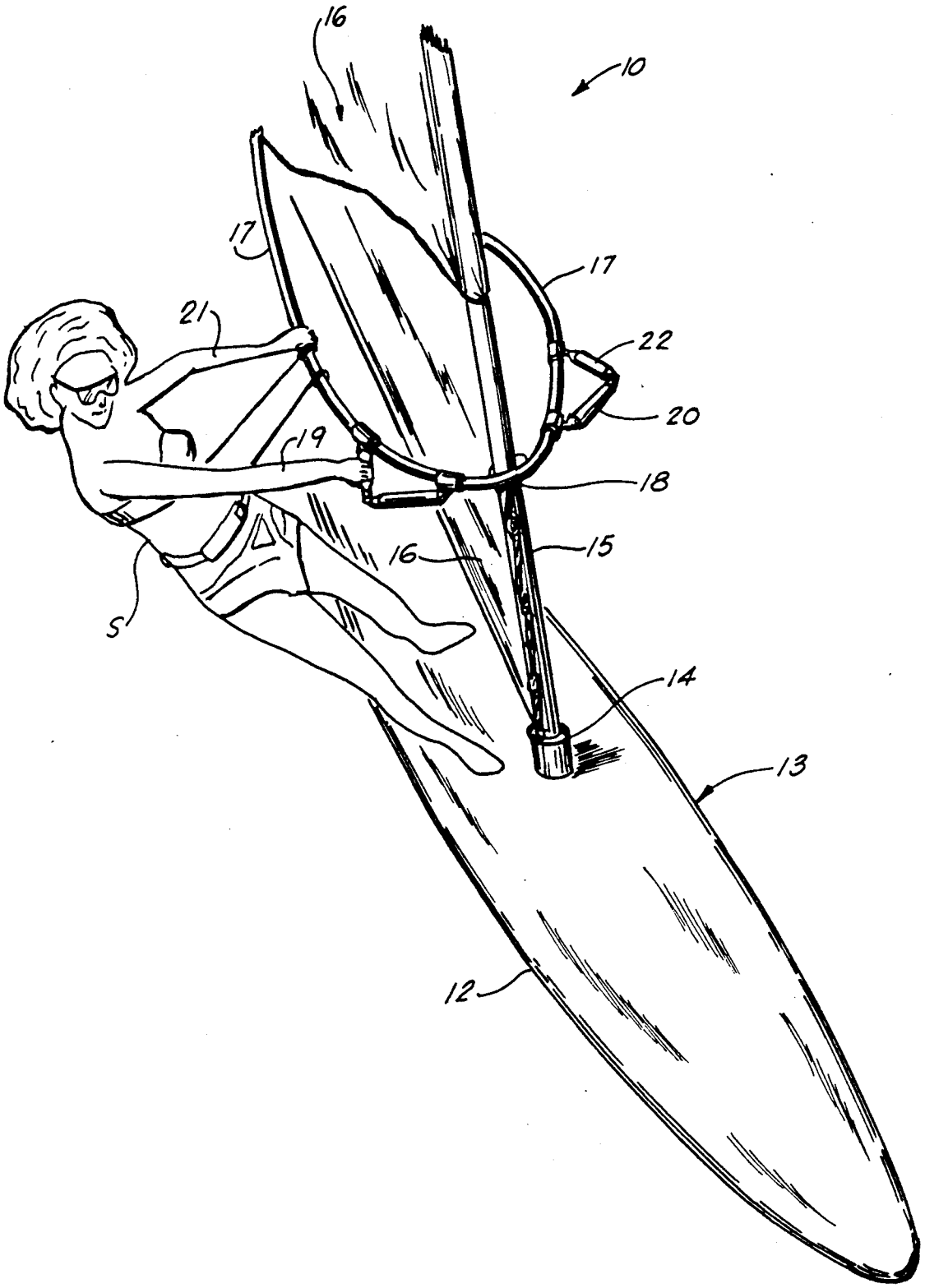
FIG. 1 is a perspective view of the preferred embodiment of the apparatus of the present invention.
Figure 3:
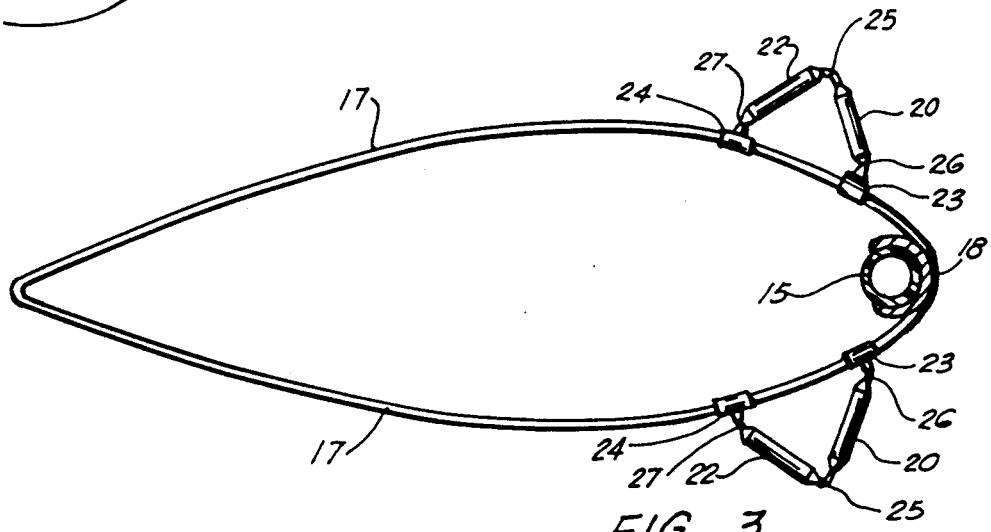
FIG. 3 is a top view of the preferred embodiment of the apparatus of the present invention.

FIGS. 1 and 3 best illustrate the preferred embodiment of the apparatus of the present invention designated generally by the numeral 10. In FIG. 1, there can be seen an elongated sailboard 12 which movably supports at its center portion 13 mast 15 at support 14. Mast 15 is elongated and carries a sail 16. An elongated and generally oval or elliptical shaped boom 17 attaches to the mast at 18 and provides a gripping surface for the sailor S. This construction of board, elliptical boom, mast and sail is commercially available, sold under the marks BIC and MISTRAL for example. The sailor S grabs the elliptical boom in using prior art, commercially available sailboards.

The present invention provides an improved handle assembly 10 wherein the forward arm 19 of sailor S grips the handle assembly 10 which includes in the preferred embodiment a pair of spaced apart handle sections 20, 22 which are respectively fore and aft handle sections. The rear 21 arm of the sailor S would typically grab the boom 17 at its middle portion measured fore to aft.

The forward arm 19 of the sailor typically becomes fatigued with prior art sailboards because the sailor is required to twist the wrist into an awkward position during sailing because of the shape of the elliptical boom in the forward area (i.e. forward one third). As can best be seen in FIG. 3, the apparatus 10 of the present invention provides an improved handle assembly 10 wherein the forward 20 and rearward 22 handle sections can be moved into virtually any angular position with respect to the user by simply moving the attachments 23, 24 fore and aft upon boom 17.

Figure 2:
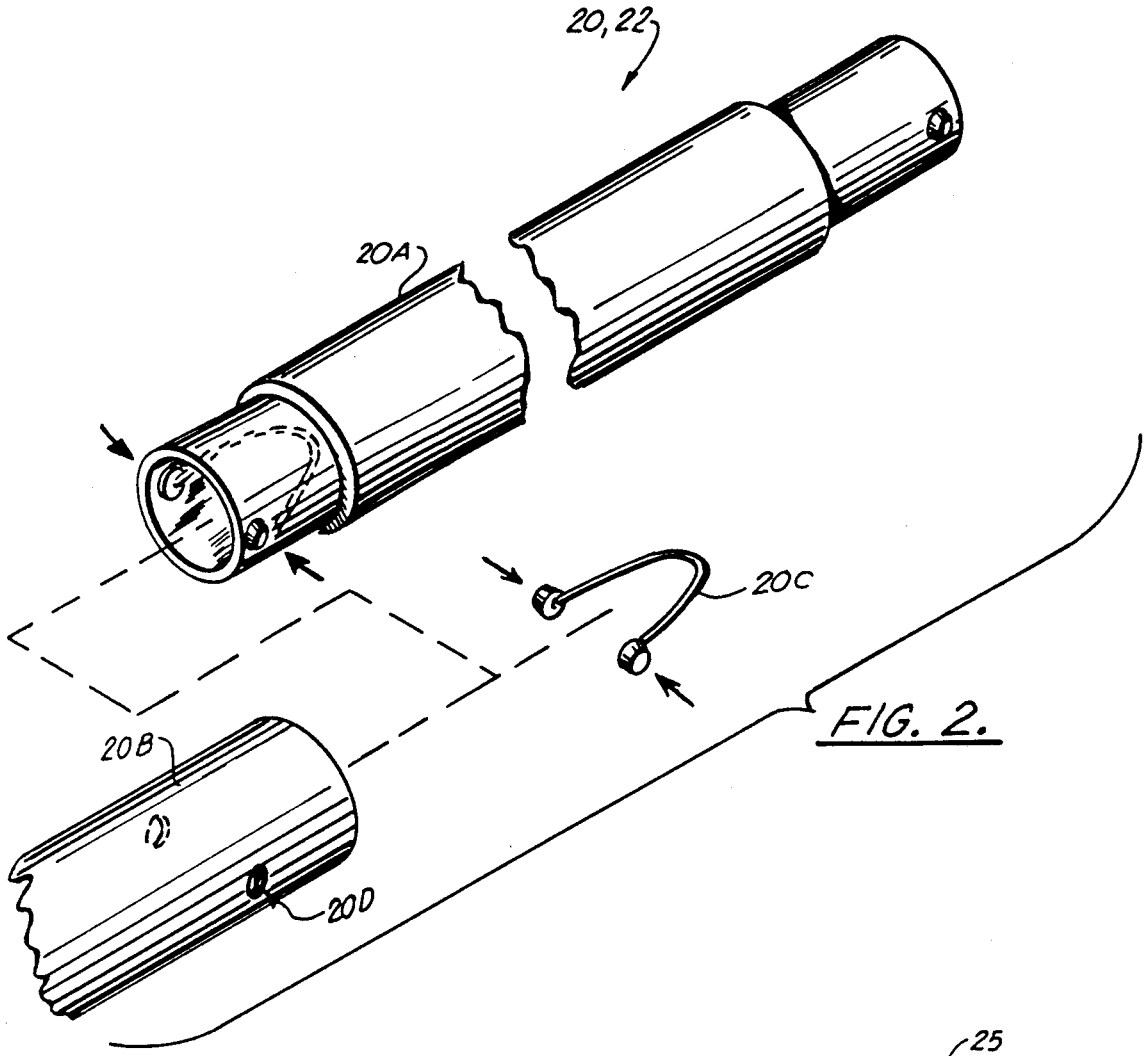
FIG. 2 is a fragmentary exploded perspective view of the preferred embodiment of the apparatus of the present invention.
Figure 4A:
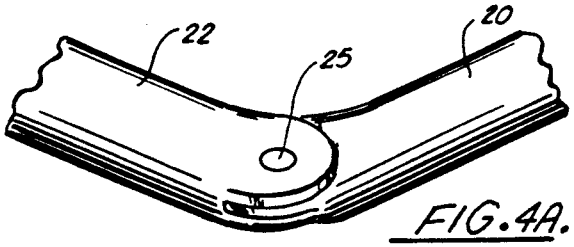
FIGS. 4–4A are fragmentary perspective views of the preferred embodiment of the apparatus of the present invention.
Figure 4:
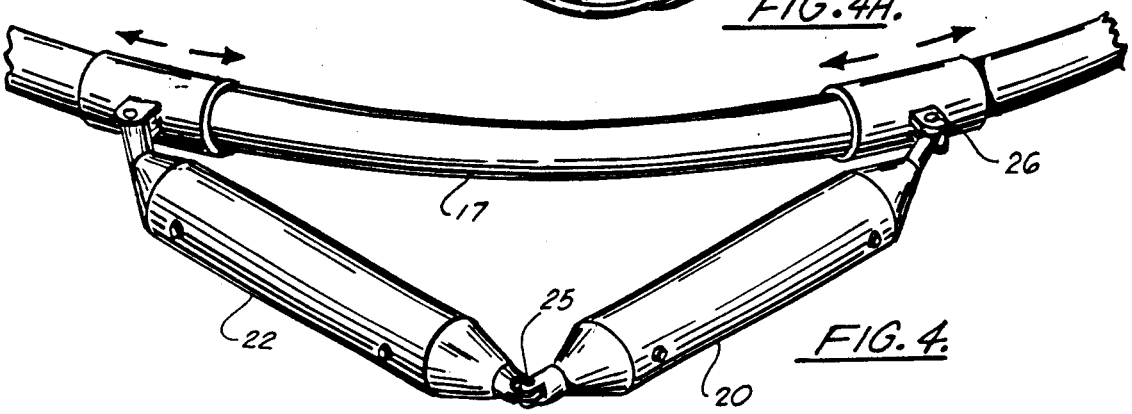

The handle sections 20, 22 are connected end to end at pivot 25 (FIGS. 4–4A). Each handle section 20, 22 can be made of separate, connectable sections such as 20A, 20B as shown in FIG. 2. Sections 20A, 20B can be connected using spring clip 20C that register within aperatures 20D of each section 20A, 20B. Pivotal connections 26, 27 are provided which respectively connect handle members 20, 22 to attachments 23, 24. Each attachment 23, 24 is preferably a sleeve-like member which can slide fore and aft along boom 17 but which also can rotate upon boom 17 thus varying the circumferential position of handle sections 20, 22 with respect to boom 17 if the user so desires.

Adjustability is provided for the angle that the rearmost handle section 22 forms with respect to the user and with respect to the center boom 17. There is also provided a circumferential adjustment of the handle sections 20, 22 about the boom which allows the handle sections 20, 22 to be raised upwardly or lowered depending upon the user's desire.

Figure 5:
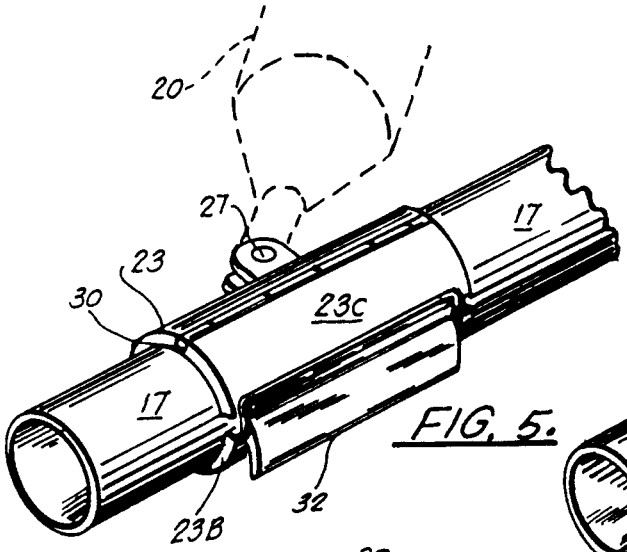
FIG. 5 is a fragmentary perspective view of the clamp portion of the preferred embodiment of the apparatus of the present invention.
Figure 6:
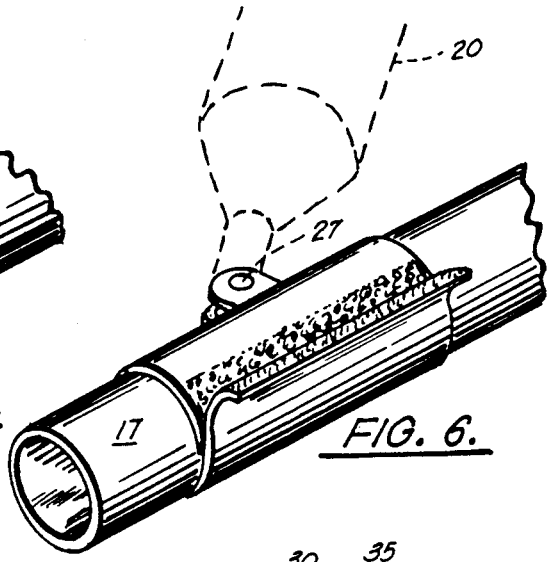
FIG. 6 is a fragmentary perspective view of an alternate construction of the present invention illustrating an alternate construction for the clamp assembly.
Figure 7:
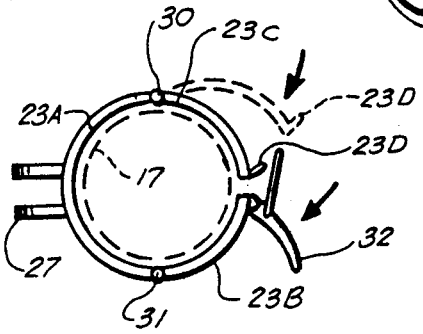
FIG. 7 is a fragmentary end view illustrating the preferred clamp arrangement of the present invention.

In FIGS. 5–8, two forms of attachments for sleeves 23, 24 are seen. In FIGS. 5 and 7, a clamping arrangement is shown which includes a sleeve 23 (or 24) having sections 23A, 23B, 23C which are joined at pivots 30, 31 as shown in FIG. 7. So that thus, the section 23C can pivot upwardly in order to remove the sleeve 23 from boom 17. A clasp 32 forms an attachment with the end 23D of sleeve 23 so that when the clasp 32 is buckled upon member 23D, a closure is formed as seen in FIG. 5.

Figure 8:
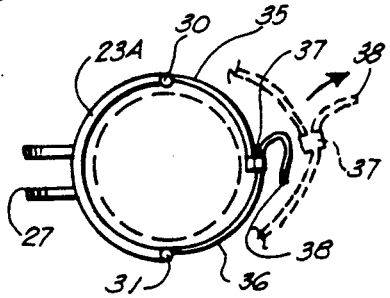
FIG. 8 is a fragmentary end view illustrating an alternate clamp arrangement of the present invention.

In the embodiment of FIG. 6 and 8, a velcro fastener arrangement is provided wherein the sleeve 23 includes a base sleeve section 23A with pivots 30, 31 and cooperating Velcro fasteners 35, 36 forming a closure wherein buckle 37 receives the end 38 of velcro section 36 and is folded downwardly upon itself which would provide a velcro type fastener which is a commercially available material.

Handle 10 can be positioned at any desired angle in reference to the sailor S, and can be placed closer or further away from the sailor's reach. Since handle member 20 is attached to the forward most part of the boom 17, there would be no loss of control on the sail 16. In fact, by pulling back on rear handle section 22, the sailor S is essentially pulling back on forward handle section 20 also. Therefore, the sailor S has the same amount of control as if he or she was grasping the forward most part of the boom 17. Since the sailor is not grasping, nor pulling directly from the forward most part of the boom 17, higher speeds can be achieved without hampering control. It is also worth noting, that since the handle 10 can be placed at any desired, pre-determined position for each individual sailor, strain and stress on the sailor's wrists and arms is no longer a factor.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An adjustable sailboard boom handle apparatus for use with a board sailor having a flat elongated buoyant board having a mast that carries a sail, the mast movably attached to the board center portion and a transverse hand held boom and attached to the mast and generally encircling the sail during use, comprising:

(a) a pair of spaced apart attachments affixable at spaced apart respective fore and aft positions along the boom;

(b) a handle assembly including fore and aft handle portions attached respectively to the boom at the pair of attachments and providing an enlarged gripping surface that is spaced from the boom during use;

(c) the pair of handle portions being pivotally attached respectively to the pair of attachments, and to each other at a position spaced away from the boom, so that the handle portions can be angularly oriented to form an angle with each other, each handle portion forming an acute angle with the boom.

2. The apparatus of claim 1 wherein the attachments are sleeve-like members that are removably attached to the boom.

3. The apparatus of claim 2 wherein the boom has a generally circular cross section and the sleeve-like members are sleeves, each rotatable about the boom so that the handle portions can be circumferentially rotated about the generally circular cross section of the boom.

4. The apparatus of claim 3 wherein each sleeve includes quick release means for quickly connecting-/releasing the sleeve to/from the boom.

5. The apparatus of claim 1 wherein the handle assembly includes a pair of separate handle portions pivotally connected end to end during use, and the pair of fore and aft attachments are adjustably affixable to the boom for sliding along the boom.

6. The apparatus of claim 5 wherein at least one of the handle portions has two or more disconnectable center sections that can be interchanged to define various preselected handle lengths.

7. The apparatus of claim 6 wherein each of the handle portions has two or more disconnectable center sections that can be interchanged to define various preselected handle lengths.

8. The apparatus of claim 5 wherein each handle portion pivotally attaches to a sleeve-like attachment.

9. The apparatus of claim 8 wherein each handle portion pivots along a path which intersects the boom.

10. The apparatus of claim 8 wherein each handle portion pivots along a path that allows the handle to collapse upon and adjacent the boom.

* * * * *